United States Patent [19]

De Forrest

[11] Patent Number: 4,463,584

[45] Date of Patent: Aug. 7, 1984

[54] PROTECTING DEVICE FOR PADLOCKS OR OTHER SIMILAR LOCKS

[76] Inventor: William E. De Forrest, 10452 Courson Dr., Stanton, Calif. 90680

[21] Appl. No.: 384,151

[22] Filed: Jun. 1, 1982

Related U.S. Application Data

[62] Division of Ser. No. 192,886, Oct. 1, 1980.

[51] Int. Cl.[3] ..... E05B 17/14; E05B 65/52

[52] U.S. Cl. ..... 70/63; 70/428

[58] Field of Search ..... 70/63, 211, 229, 232, 70/423, 424, 427, 42 B; 109/50, 57

[56] References Cited

U.S. PATENT DOCUMENTS

| | | | |
|---|---|---|---|
| 2,273,580 | 2/1942 | Kruschwitz | 70/63 |
| 3,245,240 | 4/1966 | De Forrest | 70/232 |
| 3,742,741 | 7/1973 | Cahan | 70/63 |
| 3,744,281 | 7/1973 | Logue | 70/63 |
| 4,372,138 | 2/1983 | De Forrest | 70/56 |

*Primary Examiner*—Robert L. Wolfe

*Attorney, Agent, or Firm*—K.H. Boswell; Edward D. O'Brian

[57] ABSTRACT

A protection device of the type useful for preventing access to a padlock or small combination lock as well as serving as a container for keys, incorporates a first and second half which are joined together along a junction to form a united body. The united body has a closed bottom wall and a substantially circular circumferential wall as well as a top wall. Locking means are adapted to the body to secure the first and second halves together. The top wall includes an essentially elongated opening formed partly in one of the halves and formed in the remainder in the other half. The opening is sized and shaped to allow exposure of the shank of a padlock or combination lock from the body while retaining the body of the padlock or combination lock within the hollow interior of the united body as well as retaining a bulbus member attached to an exposed U-shaped member. In using the bulbus member a protruding section of the bulbus member connects it to the U-shaped member and when the bulbus member is located in the united body the protruding section fits within the elongated opening.

1 Claim, 8 Drawing Figures

PROTECTING DEVICE FOR PADLOCKS OR OTHER SIMILAR LOCKS

This application is a division of application Ser. No. 192,886, filed 10/1/80.

CROSS-REFERENCE TO RELATED APPLICATIONS

This application is related to my U.S. Pat. No. 3,245,240 issued April 12, 1966 entitled "Knob Protector", the entire disclosure of which is herein incorporated by reference.

BACKGROUND OF THE INVENTION

This invention is directed to a protection device capable of encasing the body portion of a padlock or combination lock to prevent usage of the same. Further the invention can serve as a container for keys to a door lock. When so used it is fixedly attached adjacent to the door lock allowing the key of the protection device to serve as a means for granting and denying accessability of the door lock keys.

In my prior application U.S. Pat. No. 3,245,240 I disclosed a knob protector which is used to prevent ingress and egress to a door having a door knob with a lock from an integral part of the door knob. This knob protector fit around the door knob in a clamping like manner and prevents insertion of the door knob key into the door knob keyhole by physically denying access to the keyhole. This knob protector has found considerable utility in those applications wherein one or a multiplicity of keys to said door knob had been distributed to persons whose access to the lock in the door knob now needs to be restricted.

While the above noted knob protector serves the function it was designed for in a very expedient manner, there are other instances where it is desirable to limit access to particular areas for which my prior knob protector is not useful. Certain apartments include a storage bin, garage or other area assigned to a tenant for their exclusive use for storage of certain items which cannot be suitably stored inside of their apartment. Normally such storage areas, garages and the like will be equipped with a latching device which can be locked by affixing a padlock, combination lock or other similar device to the latch. In certain instances it may be necessary or desirable to prevent the person having the key to the padlock, the combination or other opening means to the lock from being granted access to the storage, garage, etc. Since most of the latching devices used on these storage devices, garages, etc., will not accept a second lock, presently the only way to deny access to these areas is to physically by torch, hacksaw or bolt cutters sever or otherwise mutilate the existing lock and substituting a new one. This of course renders totally inoperable the lock and can be a time consuming process when the lock used is case hardened or the like.

Along with the above noted problem the need also exists in certain industries for conveniently storing a multiplicity of keys adjacent to their respective locks in a manner which allows access to each and every one of these keys by the use of a single key. An example of this would be a car lot wherein a variety of cars are located each having a different lock. Presently each morning the totality of keys necessary for each of the cars are taken from a centralized storage place and each individual car is unlocked and the keys placed in a standard location such as on the sun visor, under the seat, etc. It can easily be seen that this can be a very time consuming process if a large number of cars are involved. Further, there is a lot of wasted effort in this process since, in fact of the multiplicity of cars unlocked during a days business, only a few of them may actually ever be opened by a salesman, customer, etc. It is, of course, impossible to have one master key which fits all the individual locks on the automobiles since, especially in a used car lot, a variety of makes and models, both foreign and domestic, may be assembled.

In the real estate industry there is presently in use a device known as a lock box. These come in several shapes suitable for uses in different environments however, their use is almost centralized with the real estate industry because of the expense involved in manufacturing the same as well as the necessity to maintain strict control to keys opening the same to prevent unauthorized burglaries, etc. The presently known lock boxes are only useful for building doors and are incapable of being adapted for use on padlocks, combination locks, automobiles, cabinets, etc. Their use therefore is limited both by their costs and their lack of compatibility with padlocks and the like.

BRIEF SUMMARY OF THE INVENTION

In view of the above it is submitted that there exists a need for a protection device which has a more universal application than the existing protection devices as exemplified by the device in my patent U.S. Pat. No. 3,245,240 and known lock boxes. It is a more specific object of this invention to provide a protection device suitable for interchangeable use both in attaching to padlocks, combination locks and the like and for providing a storage receptical for car keys, building keys and the like. It is a further object of this invention to provide a protection device which because of its simplicity of construction is economical to manufacture and therefore economical to the consumer but at the same time is engineered to be tamper proof and thus very utilitarian in its function.

These and other objects as will become evident from the remainder of this specific action are achieved in a protection device of the type having first and second protector halves hingedly associated with each other, said first and said second halves joining together along a substantially planar junction, said halves when associated together along said planar junction substantially forming a hollow united body, said united body having a closed bottom wall and a substantially cylindrical circumferential wall, said body having a top wall, locking means adapted to releaseable secure said first and said second halves together maintaining said first and said second halves as a united body, said locking means including first and second lugs respectively secured to said first and said second halves on said circumferential wall the improvement which comprises: said top wall including an essentially elongated opening opening into the hollow interior of said united body, said elongated opening formed in said first and said second halves such that a portion of said elongated opening is located in one of said first or said second halves and the remaining portion of said elongated opening is located in the other of said first or said second halves and together said portions form a singular opening in said top wall when said halves are associated together along said planar junction to form said united body; said elongated opening sized and shaped to receive both sides of the shank of a lock of the type having a U-shaped shank the ends of which are received into a monolithic lock body, said lock body of the type which includes locking means incorporated into the lock body to reversibly release the ends of one of said shank sides; the hollow interior of said body sized and shaped to contain at least said lock body within the interior of said body when the halves of said body are associated together along said planar junction forming said united body and when said lock body is contained within the interior of said body and said halves are associated together to form said united body said united body is capable of preventing access to said locking means of said lock body.

Further these objects are also achieved in a protection device of the type having first and second protector halves hingedly associated with each other, said first and said second halves joining together along a substantially planar junction, said halves when associated together along said planar junction substantially forming a hollow body, said united body having a closed bottom wall and a substantially cylindrical circumferential wall, said body having a top wall, locking means adapted to releaseably secure said first and said second halves together maintaining said first and said second halves as a united body, said locking means including first and second lugs respectively secured to said first and said second halves on said circumferential wall the improvement which comprises: said top wall including an opening opening into the hollow interior of said united body; a unified substantially U-shaped member having a first elongated side, a second elongated side and transverse section connecting said first and said second elongated sides such that said first and said second elongated sides are substantially parallel to each other; a bulbus member including a protruding section, said protruding section fixly connected to one of said first or said second elongated sides, the cross-sectional area of said protruding section sized and shaped to be smaller than said opening in said top wall such that said protruding section is capable of being located within said opening in said top wall when said sides are associated together along said planar junction forming said united body, the cross-sectional area of said bulbus member sized and shaped to fit within said body when said halves are associated together along said planar junction forming said united body and incapable of passing through said opening when said sides are associated together along said planar junction forming said united body.

BRIEF DESCRIPTION OF THE DRAWINGS

This invention will be better understood when taken in conjunction with the drawings wherein.

The invention described in this specification utilizes certain principals and/or concepts as are set forth in the claims appended to this specification. Those skilled in locksmithing arts will realize that these principals and/or concepts are capable of being expressed in a variety of embodiments different from the exact embodiment, herein depicted for illustrative purposes, without departing from the spirit or the scope of this invention. For these reasons this invention is to be construed in light of the claims and is not to be construed as being limited to the illustrative embodiments.

DETAILED DESCRIPTION

Certain aspects of this invention are similar to aspects incorporated in my U.S. Pat. No. 3,245,240 and in the interest of brevity they will not be elaborated on in detail. For construction detail of the aspects of this invention which find parallel counterparts in my above noted prior patent reference is made to that patent and incorporated by reference.

Figure 1:
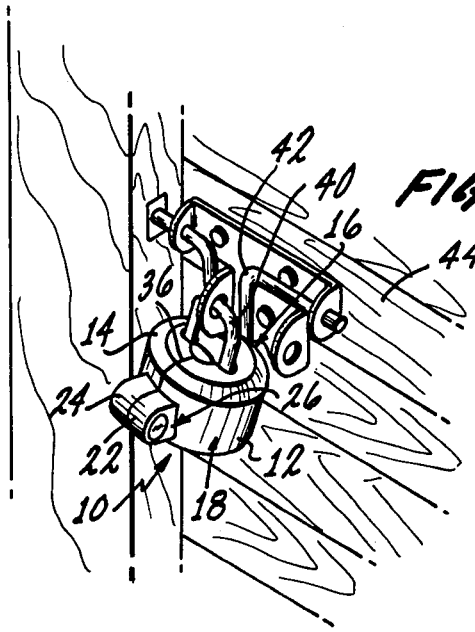
FIG. 1 is an isometric view showing the invention in use in preventing access to a padlock fixedly attached to the latching mechanism of a door.
Figure 4:
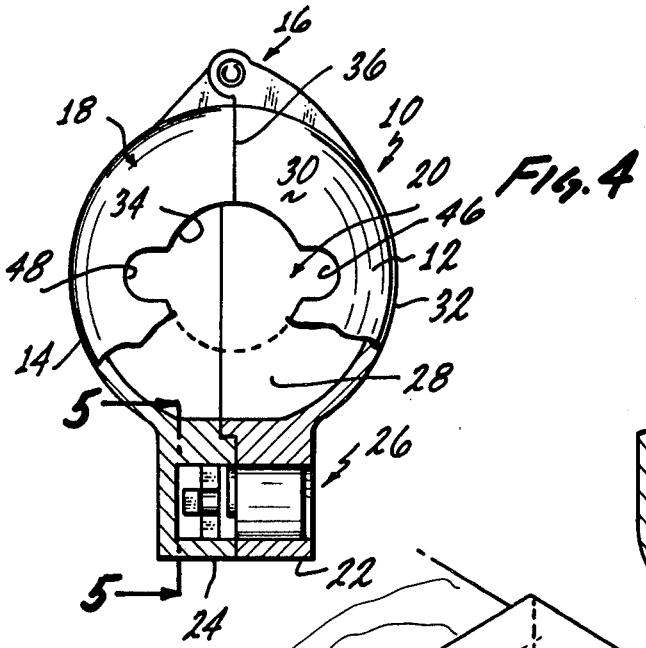
FIG. 4 is a top elevational view in partial section of the device shown in FIG. 1 isolated from both the padlock and the latching mechanism.
Figure 5:
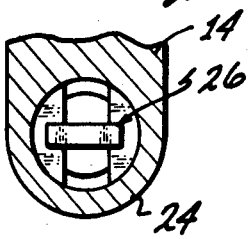
FIG. 5 is a plane view in partial section about the lines 5—5 and 6–4.

The protection device 10 of the invention is basically composed of a right half 12 and a left half 14 which are hinged together by a hinge 16 such that they can be joined together to form a united body 18. Each of the right and the left halves 12 and 14 are essentially hemicylindrical in shape and thus when they are associated together as is depicted in FIGS. 1 and 4 they form a hollow body having an interior 20. Lugs 22 and 24 are appropriately formed on the right and the left halves 12 and 14 respectively. They serve as an attaching and receiving clamp for a lock assembly 26 essentially identical to that disclosed in my U.S. Pat. No. 3,245,240.

The united body 18 has a bottom wall 28, a top wall 30 and a circumferentially extending side wall 32. One half of each of the walls 28, 30, and 32 are located on each of the right and left halves 12 and 14 respectively. Together the walls 28, 30, and 32 are capable of completely enclosing the interior 20 of united body 18 except for the opening 34 located in top wall 30. Of course when the right and left halves 12 and 14 are opened about the hinge 16 the interior 20 is exposed around the perifery of the seam line 36 dividing the right and left halves 12 and 14. For ease of manufacturing this seam line 36 forms a planar junction between the two halves 12 and 14. Additionally a tongue and groove (not separately identified or numbered) can be placed around the seam line 36 as is disclosed in my U.S. Pat. No. 3,245,240.

Figure 2:
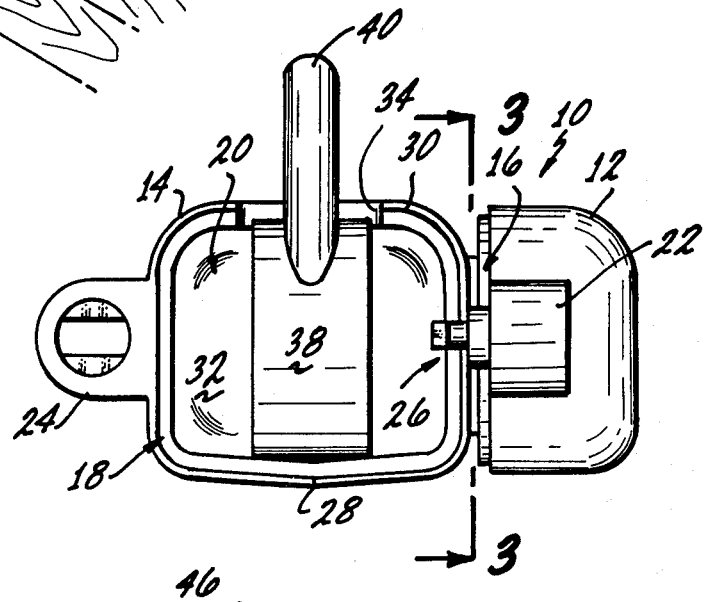
FIG. 2 is a side elevational view of the device shown in FIG. 1 with the device in an open position showing the position of the padlock inside.
Figure 3:
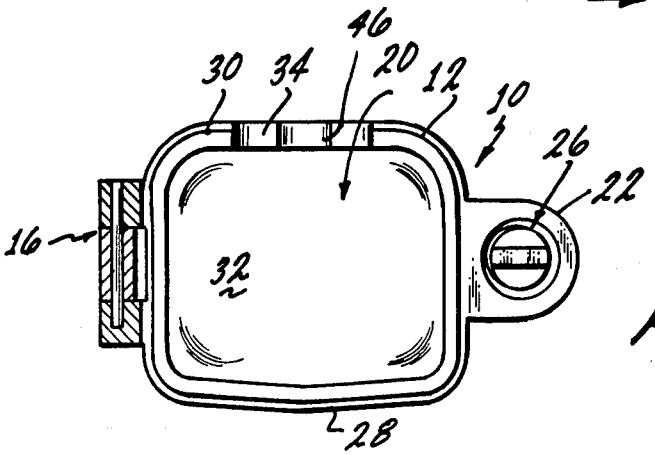
FIG. 3 is a side elevational view about the line 3—3 of FIG. 2.

The opening 34 of the protection device 10 and the interior device 20 of the protection device 10 are uniquely shaped and sized to accept a padlock, combination lock or other similar device such that the body if the lock 38 is capable of being enclosed within the interior of 20 and the shank of the lock 40 is capable of projecting outwardly from opening 34 of the protection device 10. This is best illustrated in FIGS. 1 and 2. In FIG. 2 the right and left halves 12 and 14 have been opened to expose the interior 20 of the protection device 10 showing placement of a typical lock body 38 within the interior 20 and exposure of the shank 40 from the opening 34. In FIG. 1 the protection device 10 is shown mounted around a lock with previously had been used to lock a latching device 42 onto a door 44. When in position as shown in FIG. 1 the protection device 10 will totally prevent the person who originally placed the lock on the latching device 42 from opening the lock and thus disengaging the latching device 42 to gain access to the interior of the structure protected by door 44.

In FIG. 4 the top wall 30 of the protection device 10 is shown to best illustrate the size and shape of the opening 34. The satellite openings 46 and 48 forming a part of the opening 34 accept the shank portion 40 of the lock. These satellite openings 46 and 48 are rounded such that the common round shape of the typical lock shank appropriately fits within them. While the opening 34 of the protection device 10 could be shaped as an elongated oval, i.e., simple extension between the satellite openings 46 and 48, the opening depicted in FIG. 4 is preferred shape in that as well as accepting lock shanks, this opening 34 can accept the second component 50 of the invention.

Figure 6:
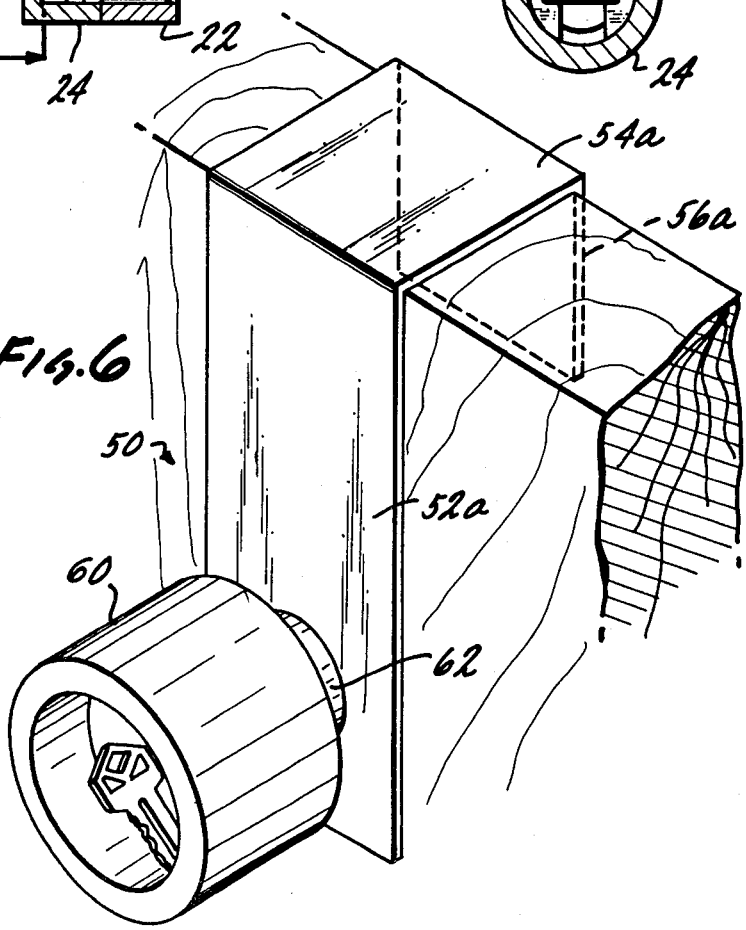
FIG. 6 is an isometric view of a component of the invention showing the location of the component on a door.
Figure 7:
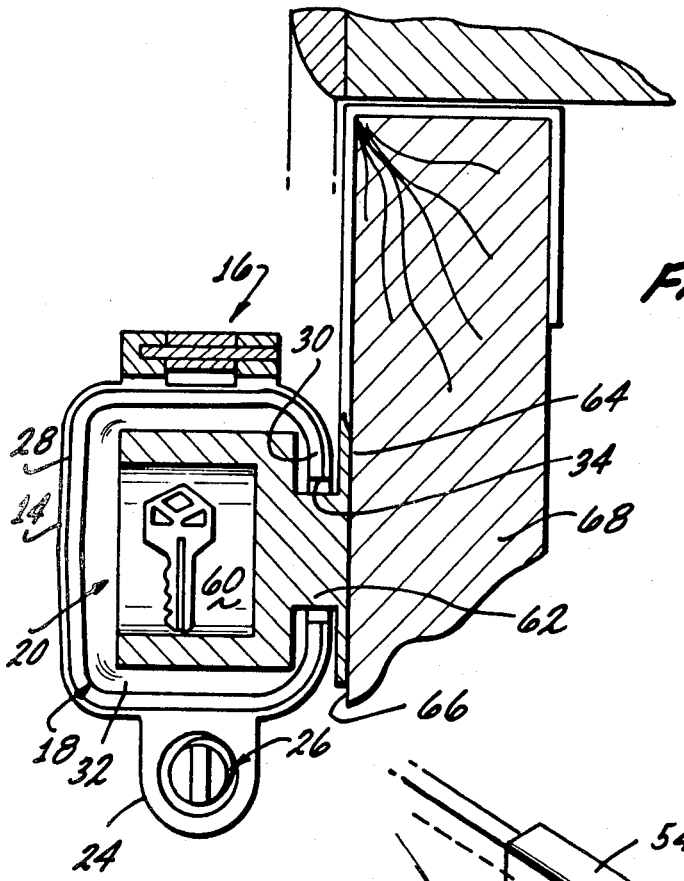
FIG. 7 is a side elevational view in partial section of the component shown in FIG. 5 as it is used in conjunction with the same component shown in FIG. 4.
Figure 8:
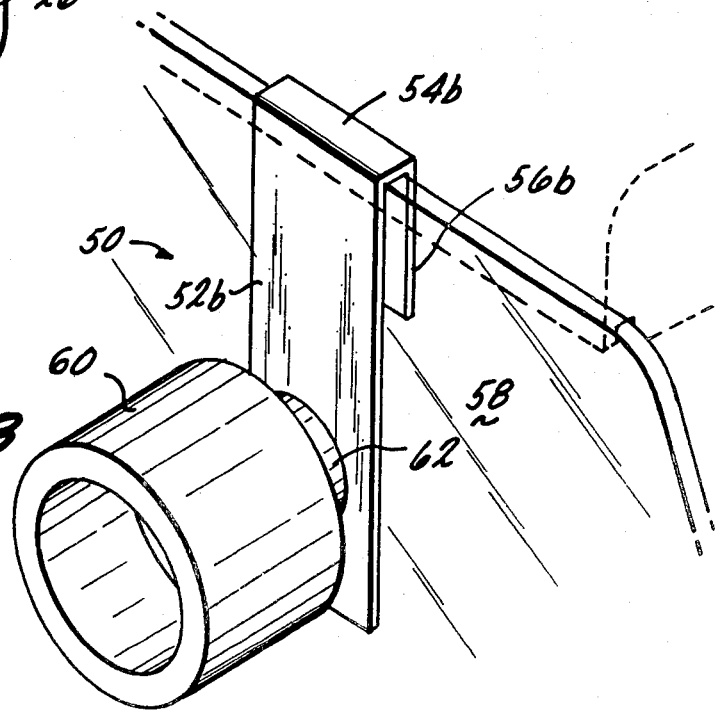
FIG. 8 is an isometric view similar to that of FIG. 6 except showing a modified embodiment of the component of FIG. 6 illustrating how this modified embodiment interacts with a window such as an automobile window.

In FIGS. 6, 7 and 8 the component 50 which operates in conjunction with the united body 18 is depicted in two different illustrative embodiments. Both of these embodiments are structurally similar but differ only in the dimension of one portion. For this reason, like numerals will be utilized within these three figures to indicate structurally identical parts with differentiation between embodiment shown by the addition of alphabetical numerals.

A first elongated side 52 of the component 50 is integrally formed with a transverse section 54 which in turn is integrally formed with the second elongated side 56. This positions sides 52 and 56 parallel to each other. Normally side 56 does not have to be as long as side 52 and in the interest of conservation of materials it is shorter. It is not mandatory however that this configuration be maintained, second elongated side 56 could be equal in length to or in fact longer than first side 52. In certain instances such as where hollow core doors are used, this in fact may be advantageous in that an elongated second side 56 would spread stress along the greater surface area of the hollow core door. When the protection device 10 is used in conjunction with an automobile window 58 as seen in FIG. 8 it might also be advantageous to elongate second side 56-*b* as compared to first side 52-*b* in order to prevent chipping of the window 58 along its upper surface by physically manipulating the component 50 in a forceful manner by an unauthorized person.

Attaching to first side 52 is bulbus member 60. Formed as part of bulbus member 60 is a protruding section 62. The diameter or cross-sectional area of the protruding section 62 is smaller than the diameter or cross-sectional area of bulbus member 60. Normally, the diameter or cross-sectional area of section 62 would be sized just slightly smaller than the opening 34 while the diameter or cross-sectional area of bulbus member 60 would be slightly smaller than the interior 20 of the united body 18 but larger than the opening 34. As can be seen in FIG. 7, this allows the united body 18 to be closed around the bulbus member 60 with the protruding section 62 conveniently passing through opening 34 prior to its attachment to first side 52.

In FIG. 7 first side 52, protruding section 62 and bulbus member 60 are shown as a united body. This would be the preferred construction, however, a different arrangement could also be utilized wherein the bulbus member 60 including the protruding section 62 would be appropriately screwed or bolted to the first side 52. By viewing FIG. 7 it, of course, is evident that any such screw or nut and bolt would not be assessable to removal once the protection device 10 is in place because any screwhead, bolthead or nut would be located within the interior of the bulbus member 60 or between the face 64 of first member 52 and the face 66 of, for example, a door 68 as shown in FIG. 7 or the window glass 58 shown in FIG. 8.

As seen in FIGS. 6, 7 and 8 the protruding section 62 is round in shape. This rounded shape essentially mimics the shape of the centralized portion of opening 34. However, this shape could be modified to include appropriate satellite lugs, now shown or numbered, which would fit into the satellite openings 46 and 48. If, of course, the protruding section 62 is round then the united body 18 is free to swivel about it. If its shape is such that it totally mimics opening 34 any rotation could, of course, be prevented. It might be advantageous in certain situations, such as usage on automobile locks discussed above, to always maintain the key opening of lock assembly 26 of the protection device 10 in an upright position for easy accessibility. In this instance, it would be preferred to shape the protruding section 62 so that it totally mimics the shape of opening 34 including lugs on the right and left side which fit into the satellite openings 46 and 47.

The bulbus member 60 as illustrated in the drawings is hollow allowing easy insertion of a key in its interior. If the protection device 10 is primarily intended to serve as a key storage unit such as on an automobile lock, by so shaping the bulbus member 60 to have a hollow interior a convenient place is provided for locating the key in a manner that once the right and left halves 12 and 14 are opened the key will not drop. The advantage of this can be seen in those situations where darkness or inclement weather may be encountered.

Normally, the first side 52, transverse section 54 and second side 56 of the component system would be formed of a metal of a suitable strength. For use on the window 58 as depicted on FIG. 8 these components could be formed of a single piece of spring steel with side 56 biased towards side 52 by the nature of this spring steel. In this way, the component 50 would be essentially clipped to the window 58.

I claim:

1. In a protection device of the type having first and second protector halves hingedly associated with each other, said first and said second halves joining together along a substantially planar junction, said halves when associated together along said planar junction substantially forming a hollow united body, said united body having a closed bottom wall and a substantially cylindrical circumferential wall, said body having a top wall, locking means adapted to releaseably secure said first and said second halves together maintaining said first and said second halves as a united body, said locking means including first and second lugs respectively secured to said first and said second halves on said circumferential wall the improvement which comprises:

said top wall including an opening opening into the hollow interior of said united body;

a unified substantially U-shaped member having a first elongated side, a second elongated side and transverse section connecting said first and said second elongated sides such that said first and said second elongated sides are substantially parallel to each other;

a bulbus member including a protruding section, said protruding section fixly connected to one of said first or said second elongated sides, the cross-sectional area of said protruding section sized and shaped to be smaller than said opening in said top wall such that said protruding section is capable of being located within said opening in said top wall when said sides are associated together along said planar junction forming said united body, the cross-sectional area of said bulbus member sized and shaped to fit within said body when said halves are associated together along said planar junction forming said united body and incapable of passing through said opening when said sides are associated together along said planar junction forming said united body.

* * * * *